US005179836A

United States Patent [19]

Dantlgraber

[11] Patent Number: 5,179,836

[45] Date of Patent: Jan. 19, 1993

[54] HYDRAULIC SYSTEM FOR A DIFFERENTIAL PISTON TYPE CYLINDER

[75] Inventor: Jörg Dantlgraber, Lohr-Sackenbach, Austria

[73] Assignee: Mannesmann Rexroth GmbH, Lohr/Main, Fed. Rep. of Germany

[21] Appl. No.: 670,303

[22] Filed: Mar. 15, 1991

[30] Foreign Application Priority Data

Mar. 19, 1990 [DE] Fed. Rep. of Germany ..... 4008792

[51] Int. Cl.[5] ..... F15B 11/08; F15B 13/09

[52] U.S. Cl. ..... 60/430; 60/445; 60/475; 60/486; 60/414

[58] Field of Search ..... 60/486, 430, 445, 452, 60/464, 473, 475, 476, 414; 91/6, 18, 28, 165, 166

[56] References Cited

U.S. PATENT DOCUMENTS

| | | | |
|---|---|---|---|
| 1,972,560 | 9/1934 | Heller | 60/430 |
| 3,864,911 | 2/1975 | Gellatly et al. | 60/486 X |
| 4,342,164 | 8/1982 | Claassen | 60/486 X |
| 4,707,988 | 11/1987 | Palmers | 60/476 X |
| 4,928,487 | 5/1990 | Nikolaus | 60/486 X |
| 4,961,316 | 10/1990 | Corke et al. | 60/486 X |

FOREIGN PATENT DOCUMENTS

| | | | |
|---|---|---|---|
| 605046 | 9/1960 | Canada | 60/486 |
| 2706091A1 | 9/1978 | Fed. Rep. of Germany . | |

OTHER PUBLICATIONS

Japanese Abstract appl. No. 57-196814 dated Nov. 11, 1982.

Japanese Abstract appl. No. 57-196815 dated Nov. 11, 1982.

Japanese Abstract appl. No. 57-195309 dated Sep. 11, 1982.

Hydraulics & Pneumatics article pp. 69-70 dated May 1975.

*Primary Examiner*—Edward K. Look
*Assistant Examiner*—John Ryznic
*Attorney, Agent, or Firm*—Harness, Dickey & Pierce

[57] ABSTRACT

A first cylinder chamber of a hydraulic cylinder is connected to a pair of variable displacement pumps of which the first one is connected to a reservoir and second one is connected to the second cylinder chamber. This allows to bias the piston by a hydraulic force acting on either side of the piston corresponding to the direction of motion. This is obtained by adjusting the delivery volume of both the pumps such that the volume supplied is larger than the volume drained. Metering the difference of both the delivery volumes results in the desired biasing counter-pressure.

5 Claims, 1 Drawing Sheet

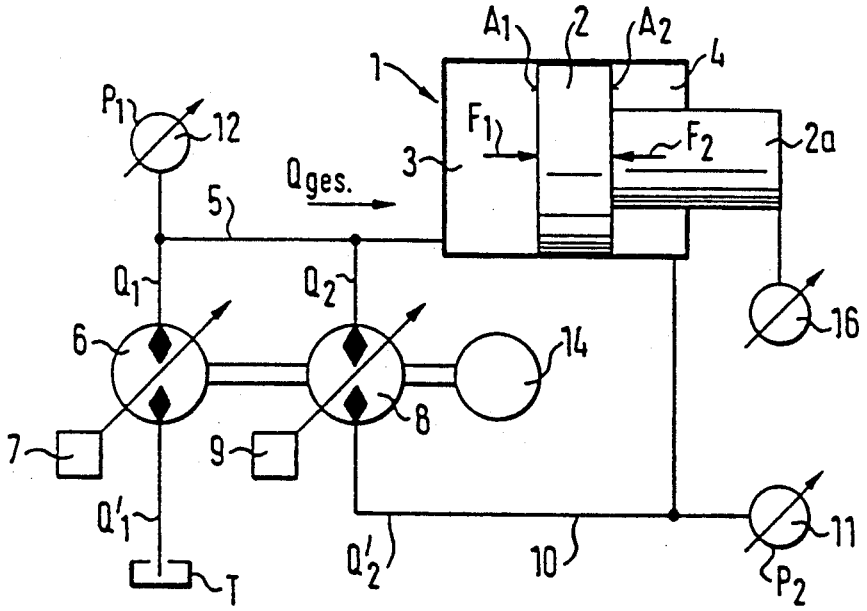
A1
2
A2
4
1
P1
12
F1
F2
2a
3
Qges.
5
Q1
Q2
16
6
14
8
7
9
Q'1
Q'2
10
11
T
P2

HYDRAULIC SYSTEM FOR A DIFFERENTIAL PISTON TYPE CYLINDER

BACKGROUND OF THE INVENTION

The present invention relates to a hydraulic system for a hydraulic cylinder, in particular of the differential piston type. The invention provides for a pump to deliver fluid from a reservoir into the cylinder space which volume increases when the piston moves, wherein fluid displaced from the opposite cylinder space is pressurized from applying a hydraulic bias force to the piston.

The term hydraulic biasing the piston of a hydraulic cylinder means that the piston is displaced against a hydraulic pressure which is generated in the cylinder space from which the fluid is displaced by the moving piston. It is known for this type of hydraulic circuits that the fluid delivered by a pump is supplied to one of the cylinder spaces through a directional control valve and the fluid displaced from the other cylinder space is returned via a directional valve and a throttling means to the reservoir. By adjusting the throttle the desired counter pressure or biasing pressure is selected.

The object of the present invention is to generate the counter pressure in a novel manner involving various advantages and to provide a hydraulic system to precisely control the counter pressure substantially free of hydraulic losses.

SUMMARY OF THE INVENTION

According to the present invention the hydraulic system for a hydraulic restraint of the piston of said cylinder is characterized in that both cylinder spaces are connected to each other via a variable displacement pump and that the larger cylinder space is connected to the reservoir via a second variable displacement pump. When the piston rod secured to the piston is drawn out the delivery volume of the pump connected to the reservoir is somewhat larger than the volume resulting from the differential area between the circular piston surface and the annular piston surface. However, when the piston rod is drawn in, the delivery volume of the pump returning fluid from the circular piston surface chamber towards the reservoir is somewhat smaller. Accordingly, this pump builds up the counter pressure.

According to a preferred embodiment of the present invention the feeding speed of the piston rod is adjusted by the delivery volume of the pump connecting both the cylinder spaces. For adjusting the biasing pressure and thus the counter pressure the flow volume of the pump connected to the reservoir is adjusted such that in addition to the differential volume between both the cylinder spaces a further volume either positive or negative depending on the direction of the piston displacement is delivered to build up a biasing pressure. This results in a total delivery volume of both pumps, which delivery volumes are added to each other or, respectively substracted from each other according to the motional direction. This allows to generate driving and biasing forces in response to predetermined desired pressure values and the actual surface areas of the piston when predetermined feeding speeds and loads prevail. Controlling the delivery volumes of the pumps results in a force control.

BRIEF DESCRIPTION OF THE DRAWINGS

Other advantages and features of the invention will appear from the following description of one non-limiting embodiment with reference to the figure, which shows a schematic illustration of the hydraulic circuit in combination with a differential piston type cylinder.

DESCRIPTION OF A PREFERRED EMBODIMENT

The figure shows a differential cylinder 1 comprising a piston 2 including a piston rod 2*a*, a piston chamber 3 and an annular chamber 4. The piston chamber 3 is connected via a line 5 to a first variable displacement pump 6, which is connected to a reservoir T. The delivery volume of the pump 6 is controlled by an adjusting device 7. A second variable displacement pump 8 including an adjusting device 9 is connected to the line 5 and to the annular chamber 4 of the cylinder via a line 10. The pressure in the annular chamber 4 is measured by a pressure transducer 11 connected to the line 10. A pressure transducer 12 is provided to measure the pressure in the piston chamber 3. Both pumps 6 and 8 are commonly driven by an electro-motor 14. The speed of the piston 1 is measured by a displacement transducer 24.

The operation is as follows: when the piston 2 is to be displaced towards the right side to draw out the piston rod 2*a* both pumps 6 and 8 deliver fluid to the common line 5 and thus to the piston chamber 3. For building up a counter-pressure acting against the moving piston the delivery rate of the pump 6 is adjusted such that it delivers from the reservoir into the piston chamber a somewhat larger volume than resulting from the differential area between the piston surface and the annular surface. This allows to adjust a predetermined speed of the piston 2 due to the delivery volume of the pump 8. Furthermore, the somewhat larger delivery volume of the pump 6 allows to build up a corresponding pressure in the annular chamber 4.

This is explained by way of an example. The area relation of the piston 2 is assumed to be 2:1. The flow rate delivered to the piston chamber 3 is determined to be 100 liters per minute. When the piston rod is drawn out, the pump 8 delivers 50 liters per minute to the cylinder chamber 3 and the pump 6 delivers the remaining 50 liters per minute. According to the area relation of 2:1 a volume of 50 liters per minute is displaced from the annular cylinder chamber 4 which volume is delivered through the pump 8 to the line 5. Accordingly the biasing pressure $P_2$ is zero. However, when the pump 6 is adjusted to deliver a somewhat larger volume than 50 liters per minute, the piston 2 will be displaced somewhat faster and accordingly will displace more than 50 liters per minute from the cylinder chamber 4. Since pump 8 is adjusted to 50 liters per minute there will be a pressure $P_2$ larger than zero.

Contrarily, when the piston 2 including the piston rod 2*a* is displaced towards the left side i.e. the piston rod is drawn in, the second pump 8 is adjusted to deliver fluid from the piston chamber 3 into the annular chamber 4, whereas the volume displaced from chamber 3 is returned to the reservoir via the first displacement pump 6. Accordingly, the pump 6 is adjusted to deliver a somewhat smaller volume to the reservoir than would regularly result from the difference of the volume delivered by the second pump 8 from the piston chamber 3 to the annular chamber 4. This results again in a corresponding pressure built up in the piston chamber 3. Referring to the example the pump 8 delivers 50 liters per minute to the cylinder chamber 4 and receives half the volume of 100 per minute displaced from the cylinder chamber 3 when the piston rod is drawn in. When the pump 6 receives less than 50 liters per minute from the cylinder chamber 3, wherein the pump now operates as a motor, a biasing pressure $P_1$ larger than zero is built up in the chamber 3. Accordingly, kinetic energy is fed back into the system by the pump 6 operating as a motor. This kinetic energy is fed back to the power supply by the electro-motor 14 which operates as a generator.

The hydraulic system as specified above allows to bias both faces of the piston 2 independent of its direction of displacement. This is obtained by adjusting the pump 6 such that the feeding or draining volume exceeds a value which is determined by the differential areas of both the piston surface and the annular surface. By metering this flow volume difference any desired biasing counter-pressure may be adjusted. Any leakages of the hydraulic system are compensated by increasing the delivery rate of the pump 6 correspondingly.

Valves may be provided in the lines between the pumps 6 and 8 and the cylinder to separately and individually utilize the pumps for different systems as desired. As an example it is referred to an injection molding apparatus utilizing the cylinder 1 for actuating the movable mold which has to be opened or, respectively, closed, wherein closing the mold is performed in opposition to a biasing counter-force to be adjusted in the annular chamber 4. To open the mold the annular chamber 4 is connected to the reservoir via the pump 8 whereas the fluid displaced from the cylinder chamber 3 is directly drained to the reservoir. The valves provided for this purpose are not illustrated in the drawings.

I claim:

1. A hydraulic system for a hydraulic cylinder of the differential piston type, comprising pump means for delivering fluid from a reservoir to the cylinder chamber which volume increases when the piston moves, wherein the fluid displaced from the opposite cylinder chamber is pressurized to build up a counter-pressure in this cylinder chamber to provide a hydraulic bias to said piston, characterized in that the pump means comprises a first variable displacement pump and a second variable displacement pump, both cylinder chambers being connected to each other via said first variable displacement pump and that the cylinder chamber larger in volume is connected to said reservoir via said second variable displacement pump, and means for adjusting the delivery volume of said second variable displacement pump relative to said first variable displacement pump in response to a predetermined speed of said piston so that (1) the volume of said second variable displacement pump delivers to the larger volume chamber is larger than the volume determined by the differential area between the cylinder chamber volumes when the piston moves toward the lower volume chamber, and (2) delivers a smaller volume to the larger volume chamber when said second variable displacement pump returns fluid from the larger volume chamber to the reservoir when the piston moves in the opposite direction.

2. The system of claim 1 for a differential piston type cylinder, wherein both variable displacement pumps are connected to the larger volume chamber of said differential cylinder via a common line.

3. The system of claim 1, wherein both pumps are connected to a common drive means.

4. The system of claim 1 wherein the feeding speed of the piston is controlled by adjusting the delivery volume of the first variable displacement pump and wherein the biasing force is generally controlled by adjusting the delivery volume of said second variable displacement pump.

5. The system of claim 3 wherein the common drive means comprises an electro-motor operating as a generator for feeding back kinetic energy generated in one of said pumps.

* * * * *